US005181872A

United States Patent [19]

Green

[11] Patent Number: 5,181,872

[45] Date of Patent: Jan. 26, 1993

[54] EMERGENCY PROPULSION DEVICE

[76] Inventor: Kenneth Green, 411 Carlton St, Toronto, Ontario, Canada, M5A 2M3

[21] Appl. No.: 623,447

[22] PCT Filed: Jun. 7, 1989

[86] PCT No.: PCT/GB89/00632

§ 371 Date: Dec. 4, 1990

§ 102(e) Date: Dec. 4, 1990

[87] PCT Pub. No.: WO89/12000

PCT Pub. Date: Dec. 14, 1989

[30] Foreign Application Priority Data

Jun. 8, 1988 [GB] United Kingdom ..... 8813535

[51] Int. Cl.[5] ..... B63H 1/30

[52] U.S. Cl. ..... 440/101; 440/13; 440/17; 440/21

[58] Field of Search ..... 440/13, 17, 18, 19, 440/20, 101, 21; 441/55, 56, 58, 59, 60, 61, 62, 76

[56] References Cited

U.S. PATENT DOCUMENTS

| | | | |
|---|---|---|---|
| 226,931 | 4/1880 | Rose | 440/13 |
| 571,858 | 11/1896 | Haven | 441/56 |
| 839,826 | 1/1907 | Edgar | 440/19 |
| 2,893,021 | 7/1959 | Lyndborg | 441/76 |
| 3,789,447 | 2/1974 | Lavallee | 441/59 |
| 4,310,938 | 1/1982 | Eichler | 441/61 |
| 4,527,984 | 7/1985 | Gilbert | 441/76 |
| 4,810,217 | 3/1989 | Bell | 440/101 |

FOREIGN PATENT DOCUMENTS

| | | | |
|---|---|---|---|
| 531120 | 8/1954 | Belgium | 440/13 |
| 75544 | 3/1983 | European Pat. Off. | 440/101 |
| 442296 | 11/1948 | Italy | 440/13 |
| 979288 | 1/1965 | United Kingdom | 441/61 |
| 1041324 | 9/1966 | United Kingdom | 441/60 |

*Primary Examiner*—Joseph F. Peters, Jr.
*Assistant Examiner*—Thomas J. Brahan
*Attorney, Agent, or Firm*—Anthony Asquith & Co.

[57] ABSTRACT

The device is an alternative to the conventional paddle or oars, and comprises a collapsible scoop and a handle-shaft. The scoop has top and bottom panels 14,16, hinged together along one edge 18, and side-panels. The side-panels 20 are foldable, and allow the scoop to open and close. When the handle is pushed, the scoop opens out by the action of hydrodynamic forces; when pulled, the scoop collapses. The scoop is made from a one-piece blank cut from stiff plastic sheet. The hinges are formed by locally creasing the plastic material.

11 Claims, 3 Drawing Sheets

EMERGENCY PROPULSION DEVICE

This invention relates to a manually operable water propulsion device, which is especially suitable for use as an emergency auxiliary means of propelling a small boat.

BACKGROUND TO THE INVENTION

It can be extremely important to have as an alternative some means of manual propulsion for watercraft in the event of motor failure or absence of wind. In the past various types of oars and paddles have served to propel boats through the water in such circumstances. However, such conventional paddles and oars are ineffective in propelling larger pleasure craft, such as motor launches, cabin cruisers and sailing yachts.

In many cases, there is simply no place on such craft from which a sailor can effectively use a paddle or oars. The maximum propulsive force that can be obtained with a conventional paddle is relatively minor compared to the forces resisting propulsion arising from water pressure against the hull, wind, inertia and so forth. Furthermore, it is very difficult in such craft to direct the little propulsive force that can be obtained with a paddle in a suitable direction to propel the craft in a direct course. Typically, paddling causes the boat to rotate, rather than to move forwards.

THE PRIOR ART

Previously, some attempts have been made to design a water propulsion device that consists of a scoop or envelope at the end of a handle. The device is thrust longitudinally from the rear of the boat to provide forward movement. Patent publications such as U.S. Pat. No. 3,800,734 WHANG, U.S. Pat. No. 4,098,219 TESAN, and U.S. Pat. No. 4,578,038 LENTAN provide examples. WHANG shows an umbrella-like design, with webbed ribs. The problems with designs like this are that the device is not durable enough, and is therefore unsafe, for the conditions to which it is exposed in the boating environment. Furthermore, the "umbrella" takes too long to open: a sailor can only exert thrust over a limited length of stroke, i.e. up to approximately 1.5 or 2 meters, and it may well take almost all of that stroke for an umbrella-like device to fully open out.

GENERAL DESCRIPTION OF THE INVENTION

The invention provides a propulsion device which comprises a scoop attached to a handle. The scoop is collapsible, in that the scoop comprises two panels which are hinged together in such a manner as to allow the panels to close together or spread apart. In use, preferably the axis of the hinge lies in the horizontal plain, and perpendicular to the direction of thrust.

The scoop is so arranged that, when the scoop is thrust away from the boat, hydrodynamic forces cause the two panels to spread apart; and when the scoop is drawn towards the boat, the hydrodynamic forces cause the two panels to close together. The panels have substantial area, so that once the panels start to spread, water action quickly forces them wide apart. This may be compared with an umbrella-like device, in which, because the device opens from a point, rather than along a hinge-line, only a small increase in area takes place as the umbrella starts to open. This is why so much of the stroke is wasted just in opening the scoop out, when the scoop is based on an umbrella construction.

The device of the invention is therefore able to open quickly to a configuration in which it presents a large area to the water, for powerful thrusting, and yet the device is able also to collapse quickly, which keeps down resistance on the return stroke. The fact that the scoop is collapsible means also that the propulsion device of the invention can be easily stored on the boat during periods of non-use.

One requirement of a manual propulsion device, if it is to be successful, is that the device should be easy to control. When the device is thrust into the water, there should be no tendency for the device to plunge below the surface, nor to rise up out of the water, nor to slip sideways. Ideally, the device should be self-guiding, so that the scoop remains just below the surface, and has no tendency to move to right or left. It is recognised, in the invention, that such forces tending to make the scoop deviate from the desired path need not be entirely eliminated: rather, the device should be such that the deviation forces are small enough to be controlled without requiring too much skill and strength of the sailor, so that the sailor is free to use his strength to propel the boat.

The device of the invention also includes side panels, in addition to the said top and bottom panels. These side panels lie in the plane of movement, and act to stabilise the scoop against movement in the lateral direction. In other words, the side panels act like rudders, to prevent the scoop from slipping sideways.

It is important that the scoop should have a high coefficient of drag, as it is thrust against the water. In the invention, the form of the scoop, as defined by the panels, creates a high degree of resistance to motion of the scoop through water, the reaction to that drag being ample for the purpose of propelling a small boat. Equally, the scoop of the invention, when collapsed, is such that on the return stroke drag is quite small.

Thus, the scoop of the invention is quick to open and close, and directionally stable in use, and is easy to stow on the boat during periods of non-use. It will also be seen from the description which follows that the device may be highly robust, and is suitable to be stored on a boat for long periods, and yet be instantly ready for use in an emergency. As to manufacture, the device of the invention is extremely economical to produce.

DETAILED DESCRIPTION OF PREFERRED EMBODIMENT

By way of further explanation of the invention, an exemplary embodiment of the invention will now be described with reference to the accompanying drawings, in which.

Figure 2:
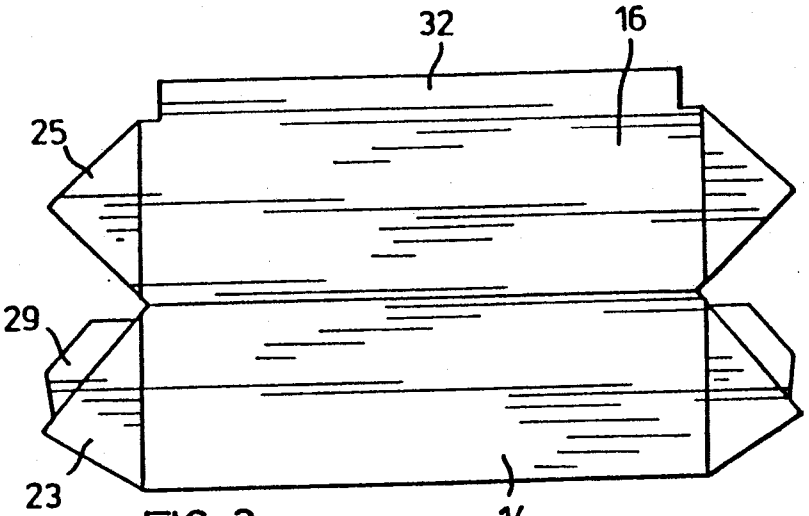
FIG. 2 is a plan of a sheet or blank from which the scoop of FIG. 1 is made, shown during a preliminary stage of manufacture of the scoop.
Figure 5:
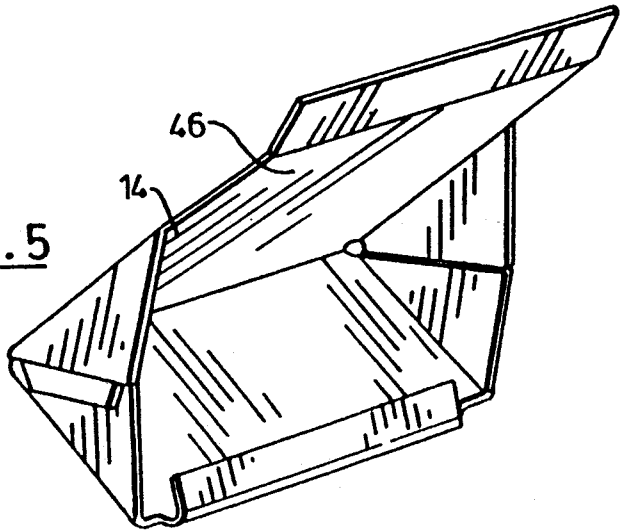
FIG. 5 is a view corresponding to FIG. 1, showing a modification.

The propulsion devices shown in the accompanying drawings and described below are examples of propulsion device which embody the invention. It should be noted that the scope of the invention is defined by the accompanying claims, and not necessarily by features of specific embodiments.

The propulsion device 8 shown in FIGS. 1–4 comprises a handle 10 and a scoop 12. The scoop is collapsible in accordance with the invention.

The scoop 12 is formed from a single flat sheet 13 of stiff, hard plastic, which is about 2 mm thick. The scoop 12 includes a top panel 14 and a bottom panel 16. These two panels are hinged together along the axis of a hinge 18. The hinge 18 is of the "living" hinge type, in which the hinge is formed by locally thinning or creasing the plastic material along a line, by means of heat.

The scoop 12 also includes two connecting panels, comprising left and right side panels 20. Each side panel has an upper portion 23 and a lower portion 25. These portions are hinged respectively to the edges of the top and bottom panels 14,16 by means of hinges 27.

The upper portions 23 are provided with tabs 29, which are welded to the upper margin of the bottom portion, by means of which the two portions are fixed together to form the complete side panel 20. A further hinge 30 is formed by heat-creasing the material of the upper portion, close to the tab 29.

The scoop 12, by virtue of this construction, is capable of opening and closing with ease. When the scoop is closed, the arrangement of hinges permits the two portions 23,25 of the side panels 20 to fold together, and permits the top and bottom panels 14,16 to fold together. When the scoop is opened, the side-panels 20 unfold, and open out flat; the extent of the movement apart of the top and bottom panels is limited by the opened-out dimensions of the side-panels.

The handle 10 of the propulsion device includes a simple wooden shaft or pole. The bottom panel 16 is provided with a socket 34, which is dimensioned to receive the shaft. Once the shaft has been inserted into the socket, the shaft may be locked in place by means of a cotter pin 36. A suitable hole 38 is provided in the shaft 40 and in the socket for receiving the cotter pin. The cotter pin may be kept captive on the socket until needed.

Figure 4:
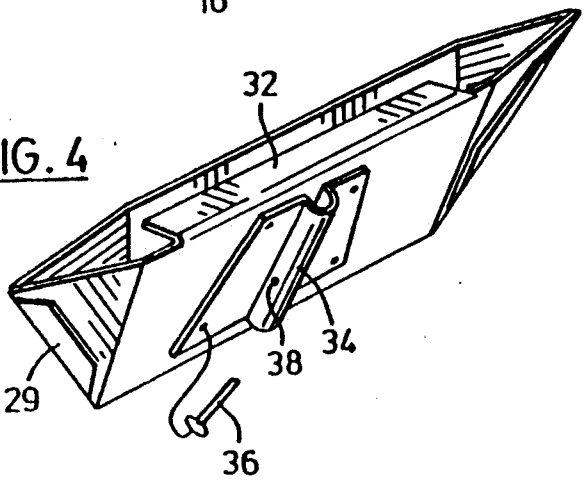
FIG. 4 is a view corresponding to FIG. 1, but showing the scoop in the collapsed condition.

The socket 34 comprises a piece of sheet metal, preferably stainless steel, which is bent to form a tunnel, as shown in FIG. 4, when the sheet is attached to the bottom panel 16. Alternatively, the socket may be formed as a plastic component and bonded to the panel.

Figure 3:
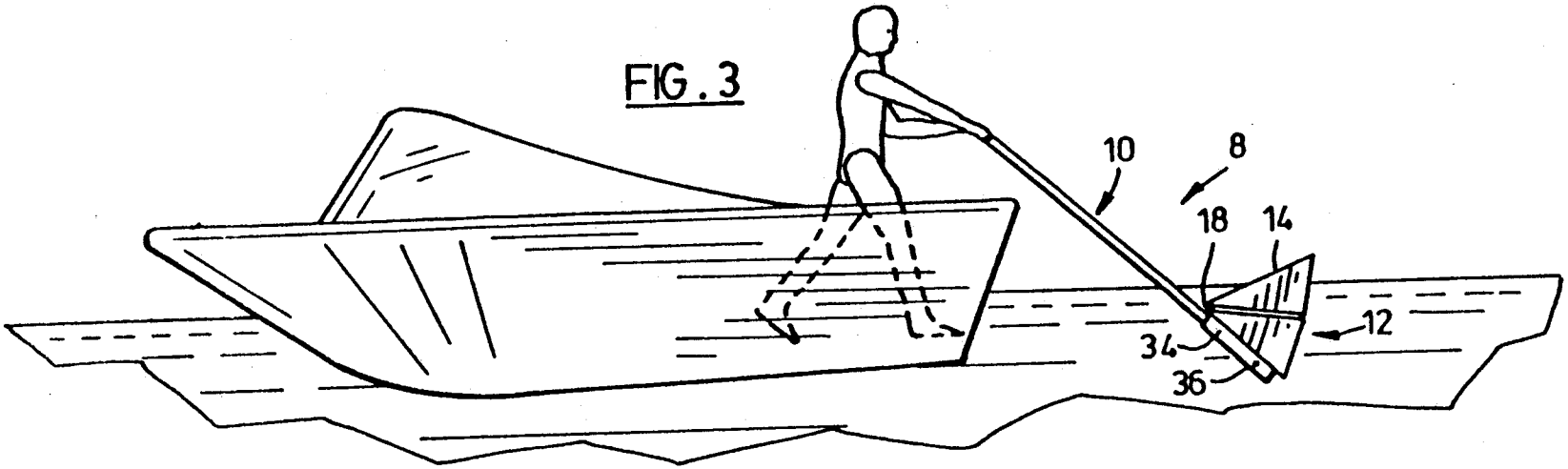
FIG. 3 is a side elevation of a propulsion device, in use for propelling a boat.

In use of the propulsion device, a sailor seeking to propel a disabled small boat first assembles the propulsion device by placing the handle 10 into the socket on the scoop 12, and securing it thereto. Then, the sailor positions himself at the rear of the boat, and lowers the scoop into the water, over the transom. As he pushes backwards on the handle, as shown in FIG. 3, the scoop opens out, by the natural action of the water, and the sailor is enabled to create a thrust against the water, by means of which he may propel the boat.

When he has pushed the propulsion device as far as he can reach, the sailor draws the scoop back in towards the boat. This action causes the scoop naturally to collapse, so that the scoop now presents only a minimum resistance to the water. By alternately pushing the propulsion device away from, and then drawing it towards, himself the sailor may produce a net propulsive force on the boat, tending to drive the boat forwards.

Formed at the forward end of the bottom panel 16 is a lip 32. The lip 32 is formed by bending the material of the sheet 13, rather than by creasing the material. The lip 32 is therefore not hinged but remains rigid with respect to the panel 16. The lip serves to prevent the top and bottom panels 14,16 from becoming fully closed together. Thus, when the sailor commences the next thrust, the panels are already partially opened, and therefore tend to spread apart readily. If the panels were to be allowed to close together completely, it might happen that merely pushing the propulsion device against the water would not open the panels.

As regards manufacture of the propulsion device, it will be noted that the scoop is formed from a single stamped out blank 13 of sheet plastic material. The "living" hinges also are formed by a simple press operation. The upper and lower portions of the side panels have to be welded together, which is an undemanding production task. The propulsion device of the invention therefore can be manufactured by simple, inexpensive, and foolproof production steps.

As regards storage of the propulsion device on the boat, prior to use, it will be observed that the propulsion device as shown will fold flat, or almost flat. The propulsion device should preferably be stowed, when not in use, in a safe place on the boat, and the ability to be folded flat is important in this connection, so that the device can be stowed neatly and unobtrusively. However, it will inevitably happen sometimes that the propulsion device will be stowed in such a manner that the propulsion device is vulnerable to damage. The propulsion device as shown is very rugged, and can survive even being stepped on quite violently for example, without being damaged. The propulsion device of the invention, including both the scoop and the handle, is in any event no more difficult, and in some respects easier, to stow on a small boat than a pair of oars.

The plastic material used for making the scoop is quite stiff and rigid, and the material does not "give" very easily at the hinges. One way in which cracks and splits might develop would be if the hinges were overstrained. The panels, made of the plastic material as described, would not be flat, but would be curved to some extent. This is because the process of stamping out a blank from sheet, followed by heat creasing and welding operations, tend to distort the panels from the truly flat to some small extent. Thus the hinges might easily become overstrained if the panels were to be called upon to lie flattened against each other.

One benefit of the presence of the lip 32 is that the top and bottom panels 14,16 cannot quite close together. This prevents the hinges between the panels from being overstrained. When living hinges are to be folded quite flat, it is possible to reduce the risk of over-straining by forming a second hinge-crease, parallel to and alongside the first. Even so, it is preferred, in the invention, that the hinges be arranged so as not to fold flat.

Hinges formed by creasing plastic material are of course extremely inexpensive, and therefore attractive for that reason. Such hinges should only be used, however, where (a) the required range or arc of movement is limited, (b) the movement does not take the hinge to, nor through, a strained position, (c) the movement occurs not on a regular continuous basis, but only occasionally, and (d) no movement takes place at freezing temperatures. It is recognised in the invention that these limitations can be easily accommodated in the propulsion device described. Although the device will often be left in the boat over the winter, it is recognised that the material will recover its suppleness when the weather becomes warmer. In fact, many plastic materials can stand to be flexed at freezing temperatures, and still have an adequate service life.

It is recognised that the propulsion device of the invention is a structure in which the limitations of "living" hinges can be accommodated, and that the device is eminently suitable for such hinges.

It is certainly a limitation of living hinges that constant flexing of the hinge will cause a crack or tear to develop. However, such flexure causes the plastic material to become warm, and the warmth contributes to the development of the crack. It may be noted that device of the invention is immersed in water at the time flexure of the hinges takes place, and the water will tend to prevent heat developing in the hinge. The device is therefore resistant to failure due to repeated flexing, even if the device is used more often than just in the occasional emergency.

It may be noted that, if the propulsion device of the invention could only be achieved by the use of ordinary hinges, with hinge-pins etc, the usefulness of the device would be severely restricted. Apart from the extra manufacturing expense of ordinary hinges, a propulsion device that used ordinary hinges might have less expectation of surviving years of non-use, in the bottom of a boat, and be instantly ready for use if and when an emergency arose.

In the propulsion device as described, the handle shaft 40 is attached rigidly, during use, to the bottom panel 16. In use, therefore, the angle at which the bottom panel lies, relative to the water, is dictated by the height and position of the sailor, the height of the transom and deck, the length of the handle, and so on. The angle of the shaft, and therefore of the bottom panel relative to the water, will change as the thrust stroke progresses. The top panel, during the backwards-thrusting stroke, will open itself out as far as possible from the bottom panel, and the angle of the top panel, relative to the water, is therefore also dictated by the angle of the shaft.

The lip 32 may be formed on either the top panel or the bottom panel: preferably the lip is formed on the panel to which the handle is attached, to lend an extra stiffness to that panel.

During the return stroke, the top panel folds itself onto the bottom panel, whereas the bottom panel still remains at an angle relative to the water. What tends to happen is that the collapsed scoop, as it is drawn in towards the boat, tends to rise up out of the water, and to rest on top of the water. On the return stroke, therefore, the device is almost right out of the water, and the resistance to the motion of the device, during the return stroke, is therefore quite minimal.

Upon resuming the next thrust stroke, the hydrodynamic forces on the bottom panel at first makes the bottom panel plunge downwards into the water. At this time, the top panel is in the process of opening out; when the top panel is approximately horizontal, the hydrodynamic forces on the top panel tend to keep the scoop from plunging further below the surface. The effect is that although the shaft is at an angle, and the sailor is to some extent pushing downwards in addition to pushing horizontally backwards, he can easily control the scoop sufficiently for the scoop to remain at the surface. Thus the sailor is not using much of his strength just in holding the scoop to the correct position against hydrodynamic forces: rather, the invention enables him to utilise his strength to produce powerful thrusts, which are easily controlled and directed.

To enhance the tendency of the top panel to remain at the surface, the top panel may be made longer, by means of an extension 46. The increase in area of the top panel, due to the extension, would not create any appreciable extra drag, but the extra area would increase the resistance of the scoop to movement downwards below the surface. The extension may even be angled upwards so that the forward edge lies out of the water, in which case hydrodynamic forces on the top panel will tend to hold the top panel out of the water, like a ski.

To further enhance the ability of the top panel to remain at the surface, without sinking, the panel may be of hollow construction, so that buoyancy forces will tend to keep the panel at the surface. Alternatively, a flotation panel may be fixed to the top panel, to serve the same purpose. (It is preferable, in any event, that the device should float, just in case the sailor should inadvertently release the device during use.)

Since boats, and people, do vary dimensionally, it may be preferred to allow the angle that the handle makes with the scoop to be adjustable. The sailor can then set the most comfortable angle at which he can control the tendency of the scoop to sink, or otherwise deviate from the direction of thrust, but at which, at the same time, he can apply powerful propulsive strokes.

Figure 6:
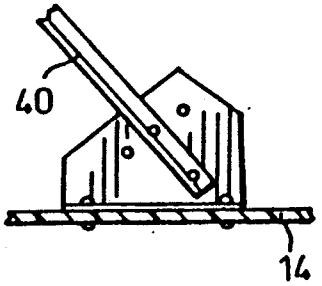
FIG. 6 is an elevation corresponding to FIG. 3, showing another modification.

As described in relation to the above propulsion device, the handle-socket 34 was located on the bottom panel 16. The handle could, on the other hand, be attached to the top panel. In this case however, the means of attaching the handle to the panel would not be the simple socket as described above, because the top panel cannot be allowed to lie in the water at the same angle as the shaft. FIG. 6 shows a suitable manner of attaching the shaft at an angle to the top panel, and it may be noted that the angle is adjustable. Naturally, the prudent sailor will practice with, and adjust, the propulsion unit at leisure, rather than trying to adjust it at the time of the emergency. On the other hand, adjustment is simple enough to be carried out at the time of the emergency, if necessary.

In the devices described, the scoop has been made from a single piece of sheet plastic. However, the scoop may be made by other means, for example by plastic moulding. The socket for the handle could be moulded into the basic form of the scoop in that case.

The handle shaft could be of telescopic construction, to cater for various sizes of boat. Alternatively, the shaft may be supplied in different lengths.

By suitable design of the socket, the scoop could be adapted for use with a boathook, or some other common item of chandlery: in such a case, it is important to ensure that the scoop cannot fall off the handle, and it is also important to keep the scoop from rotating relative to the handle.

The dimensions of the scoop are important in the invention. The scoop should not be so large that it becomes difficult for the sailor to control the propulsion forces. The scoop should not be so small that the sailor cannot make good use of his strength to propel the boat. It is recognised in the invention that it is possible to select dimensions for the scoop such that an ordinary person can provide adequate propulsion without having to resort to undue effort and skill. In the propulsion device described, the panels are 46 cm by 23 cm.

The scoop as described is suitable, in an emergency, for use alternatively as a hand-baler, if that emergency were to arise. For this reason it would be preferred that the scoop be stowed, on the boat, separate from, i.e. not attached to, the shaft.

Figure 1:
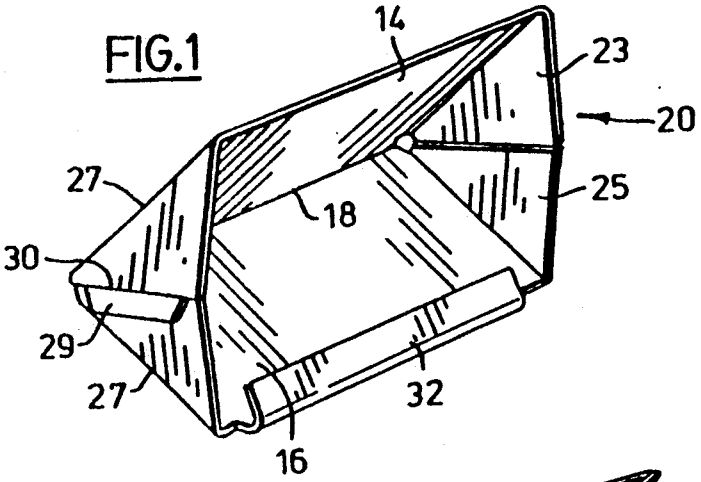
FIG. 1 is a pictorial view of the scoop of a propulsion device which incorporates the invention.
Figure 7:
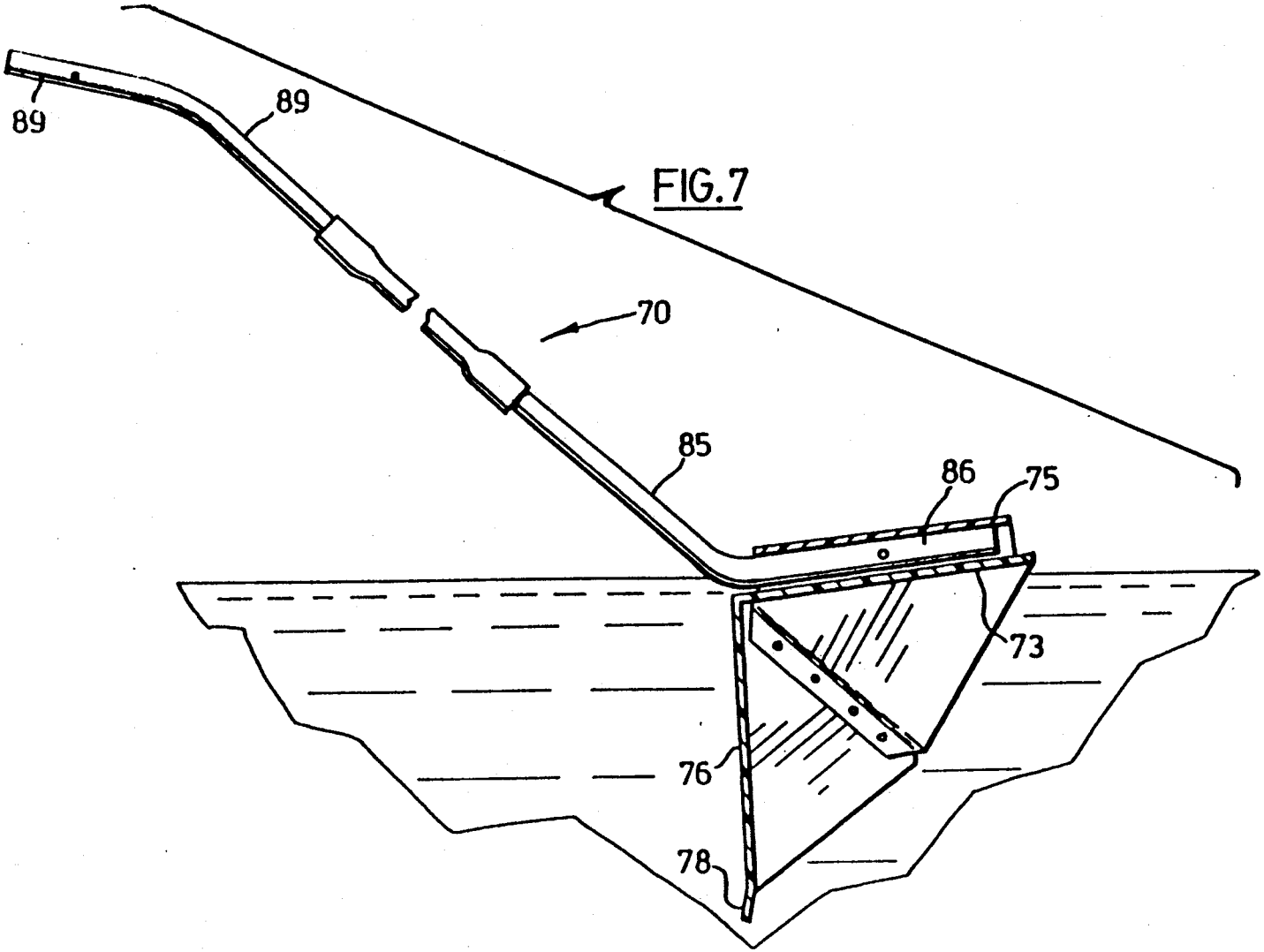
FIG. 7 is a cross-sectional view, corresponding to the FIG. 3 elevation, of an alternative embodiment of the invention.

FIG. 7 shows an alternative embodiment of the invention, in which the panels are arranged as in the FIG. 1 embodiment, but with the following differences. In FIG. 7, the handle 70 is coupled to the top panel 73, via a socket 75. The lip 32 is omitted and the bottom panel 76 instead has a bent-back rib 78, to stiffen the bottom panel.

The handle 70 is in three sections, which telescope together, and which may be separated for storage. The lower portion 85 is bent at an angle, the angled extremity forming a spigot 86 which engages the socket 75.

The FIG. 7 embodiment has the following attributes. The angle between the top panel 73 and the handle 70 is such that the top panel tends to lie almost flat on the surface of the water; almost flat, that is, by comparison with FIG. 3: the top panel should still slope up out of the water slightly. The bottom panel, by the same token, lies (almost) perpendicular to the surface.

This disposition of the panels is such that the sailor can operate the device almost without his having to steady the handle in any way. In other words, the sailor simply pushes on the device; he does not have to save part of his effort to hold the device straight. In fact, the sailor can often operate the device simply by pushing with the palm of his hand, supplying no other constraining forces to the device at all, and even then the scoop tends to remain straight, and tends to remain at the surface. The sailor cannot use this simple palm-push throughout the total length of the stroke: at the beginning of the stroke, the angle of the handle is rather steep, with the result that there is some tendency for the scoop to bury itself in the water. The sailor must resist this tendency, which he does by the manner in which he grasps the handle. But once into the stroke, the angle of the handle becomes less steep, and a simple in-line thrust along the length of the handle is all the sailor need now provide. It is found that, over the major part of the length of the stroke, the sailor is enabled to direct all his strength into simply pushing the handle, because the scoop tends not to slip or deflect sideways, nor to rotate, nor to bury itself in the water.

The angle of the handle relative to the top panel is important, and the ideal angle will depend to some extent on the size (and strength) of the sailor, on the size of the boat, and on the disposition of the place in the boat where the sailor will stand to operate the device. The handle 70 of FIG. 7 is reversible, in that the bent over end 87 of the upper portion 89 also serves as a spigot for engagement with the socket 75. The two spigots lie at different angles, and the sailor may experiment with both, to see which gives the most comfortable operation.

It usually turns out that the most advantageous angle is that at which the line of the handle bisects the angle between the top and bottom panels.

When the sailor is pulling on the handle, during the return stroke, the scoop collapses rapidly, and again just a simple in-line pull is all that is required. However, from time to time, the sailor will wish to lift the device out of the water, for example to move the device round to the other side of the boat: now of course a simple pull will not be sufficient, and the sailor must manipulate the handle, but the device as described is light enough to make such manipulation easy. It may be noted that the scoop collapses in such a way that there is no tendency for water to be retained within the scoop when the scoop is being lifted out of the water.

It is preferred, from the point of view of collapsing the scoop, to attach the handle to the top panel. In FIG. 7, it will be appreciated that the bottom panel 76 pivots upwards immediately upon commencement of the return stroke, due to hydrodynamic forces: if the handle were to be attached to the bottom panel 76, it will be appreciated that such collapse would not be so immediate.

The purpose of the lip 32 of FIG. 1 was to ensure that the two panels could never close completely against each other, but such a precaution is often not needed, especially if the material of the scoop is stiff and unpliant.

I claim:

1. Auxiliary propulsion device for a boat, wherein:

the device includes a collapsible scoop, and a shaft-handle;

the arrangement is such that a person in the boat may apply a thrust-force through the handle to the scoop, in direction to the rear of the boat, the reaction to said thrust-force being effective to propel the boat forwards;

the scoop comprises a top panel, a bottom panel, and at least one connecting panel;

the top and bottom panels have front and rear edges;

the scoop includes a main hinge, upon which the top and bottom panels are hinged, and which is operatively connected between the rear edges of the top and bottom panels;

the scoop is capable of adopting two conditions, a wide open condition and a collapsed condition;

in the wide open condition, the top and bottom panels are pivoted apart about the main hinge, and in the collapsed condition the top and bottom panels are pivoted together about the main hinge;

in the wide open condition, the top and bottom panels present a comparatively large rearward-facing area to the water, said area being in the plane lying transverse to the direction of thrust;

in the collapsed condition, the top and bottom panels present a comparatively much smaller area to the water in said transverse plane;

the arrangement of the scoop is such that the scoop collapses to the closed condition upon being drawn through the water in the opposite direction to the direction of thrust;

the arrangement of the scoop is such that the at-least-one connecting panel, at least in the wide open condition, lies substantially edge-on to the direction of thrust, whereby the connecting panel acts as a rudder to prevent the scoop deviating from the direction of thrust;

the at-least-one connecting panel comprises an upper and a lower portion;

the upper portion of the connecting panel is hinged to the top panel about an upper hinge;

the lower portion of the connecting panel is hinged to the bottom panel about a lower hinge;

the two portions of the connecting panel are hinged together about a side hinge;

the top panel, the bottom panel, and the upper and lower portions of the connecting panel, are all of a substantially stiff, non-flexible, plastic sheet material;

all the said hinges are living hinges, being hinges of the kind formed by locally thinning the sheet material;

one of either the top panel or the bottom panel is provided with a coupling means for coupling the shaft-handle to that one panel;

the said coupling means is so arranged that, in operation of the device, the shaft-handle and that one panel are coupled together in such a manner that the shaft-handle can undergo substantially no pivoting or any other movement relative to that one panel during the said relative pivoting movement of the two panels, from the wide open condition to the collapsed condition of the scoop.

2. Device of claim 1, wherein the scoop includes two of the said connecting panels, comprising a left side panel and a right side panel.

3. Device of claim 2, wherein the left and right sides panels are connected between the left and right extremities respectively of the top and bottom panels.

4. Device of claim 3, wherein the scoop is formed from a one-piece blank from a sheet of stiff plastic material.

5. Device of claim 1, wherein the axes of the upper hinge, the lower hinge, and the side hinge converge at a point, and the said point lies on the axis of the main hinge.

6. Device of claim 1, wherein the means for coupling the handle and the scoop together includes a socket means in one of the upper or lower panels, and includes a spigot means on one end of the handle for engagement with the socket.

7. Device of claim 6, wherein the coupling means is so arranged that, when the handle is held by a person, and the scoop is in the wide open condition, a line drawn from the person's hand to the main hinge substantially bisects the angle between the upper panel and the lower panel.

8. Device of claim 7, wherein:

the handle includes a main length;

the spigot means comprises one end of the said length;

the handle is angled, near the one end, in such a manner that the spigot lies at a substantial angle to the main length;

the handle includes an alternative spigot means at its other end;

the handle is angled, near the said other end, in such a manner that the alternative spigot lies at a substantial angle to the main length;

and the angles of the two spigot means, relative to the main length of the handle, are substantially different.

9. Device of claim 6, wherein the device includes a tunnel-shaped plate, which is attached to that one panel, and which defines the socket.

10. Device of claim 1, wherein the said coupling means includes a means for selectably coupling the shaft-handle to, and disengaging the shaft-handle from, the said one panel.

11. Auxillary propulsion device for a boat, wherein:

the device includes a shaft-handle and a scoop;

the shaft-handle is adapted to be held in the hand of a person using the device to propel a boat;

the scoop comprises a single, unitary piece of stiff sheet plastic material;

the single piece of plastic material is provided with creases comprising local thinning of the said plastic material, whereby the creases comprise hinges of the kind known as living hinges;

the disposition of the creases in the piece of plastic material is such as to define four panels, being a top panel, a bottom panel, and left and right side panels of the scoop;

the disposition of the creases in the piece of plastic material is such as to divide the left and right side panels into respective upper and lower portions;

the disposition of the creases in the piece of plastic material is such as to provide a main hinge between the top panel and the bottom panel; left and right upper hinges connecting the upper portions of the left and right side panels to the top panel; left and right lower hinges connecting the lower portions of the left and right side panels to the bottom panel; and left and right side hinges connecting the upper and lower portions of the left and right side panels;

the single piece of plastic material is, in substance, rigid and inflexible apart from being foldable or pivotable about the said living hinges between the panels;

one of the top and bottom panels of the single piece of plastic material includes a coupling means for coupling the shaft-handle to that one panel;

the said coupling means is so arranged that, in operation of the device, the shaft-handle and that one panel are coupled together in such a manner that the shaft-handle can undergo substantially no pivoting or any other movement relative to that one panel, during relative hinging movement of the top and bottom panels.

* * * * *